US007559279B2

(12) United States Patent
Brandenburg et al.

(10) Patent No.: US 7,559,279 B2
(45) Date of Patent: Jul. 14, 2009

(54) METHOD AND DEVICE FOR REGULATING THE CROP MARK FOR A ROLLER PRINTING MACHINE WITH MULTI-WEB OPERATION

(75) Inventors: Günther Brandenburg, Gröbenzell (DE); Stefan Geissenberger, Augsburg (DE); Andreas Klemm, Bad Wörishofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 279 days.

(21) Appl. No.: 10/567,291

(22) PCT Filed: Aug. 4, 2004

(86) PCT No.: PCT/EP2004/008751

§ 371 (c)(1),
(2), (4) Date: Mar. 2, 2006

(87) PCT Pub. No.: WO2005/016806

PCT Pub. Date: Feb. 24, 2005

(65) Prior Publication Data

US 2006/0230968 A1 Oct. 19, 2006

(30) Foreign Application Priority Data

Aug. 6, 2003 (DE) ..... 103 35 886

(51) Int. Cl.
*B41F 1/34* (2006.01)

(52) U.S. Cl. ..... 101/485; 101/226; 101/227; 101/224; 101/219; 101/484

(58) Field of Classification Search ..... None
See application file for complete search history.

(56) References Cited

U.S. PATENT DOCUMENTS 3,556,510 A * 1/1971 Treff ..... 270/52.07

(Continued)

FOREIGN PATENT DOCUMENTS

DE 85 01 065 4/1985

(Continued)

OTHER PUBLICATIONS

International Search Report issued for the corresponding application No. PCT/EP2004/008751, dated Dec. 1, 2004.

*Primary Examiner*—Judy Nguyen
*Assistant Examiner*—Yuan L Chen
(74) *Attorney, Agent, or Firm*—Cohen Pontani Lieberman & Pavane LLP

(57) ABSTRACT

In order to control the cut register in multi-web operation in a web-fed press and to control the web tension in a web section, image information or measuring marks from printed webs and web tensions in different web sections are registered by sensors and supplied to a control device. To correct the cut register error of at least one web, either the speed of at least one clamping point located before the knife cylinder and/or the position of the knife cylinder and, to correct the web tension, the speed of at least one further clamping point is changed, so that the actual value of the part and/or total cut register error of at least one web and the at least one web tension arc corrected to the associated predefined set points.

21 Claims, 9 Drawing Sheets

U.S. PATENT DOCUMENTS

| | | | | |
|---|---|---|---|---|
| 5,458,062 | A * | 10/1995 | Goldberg et al. | 101/485 |
| 5,740,054 | A | 4/1998 | Dürr et al. | |
| 5,768,959 | A * | 6/1998 | Lorenzo | 83/74 |
| 6,092,466 | A | 7/2000 | Koch et al. | |
| 6,526,889 | B2 * | 3/2003 | Tokiwa | 101/485 |
| 6,598,808 | B1 | 7/2003 | Garcia et al. | |
| 6,633,740 | B2 * | 10/2003 | Estabrooks | 399/384 |
| 6,837,159 | B2 | 1/2005 | Elkotbi et al. | |
| 2001/0018872 | A1 | 9/2001 | Tokiwa | |
| 2003/0084765 | A1 * | 5/2003 | Elkotbi et al. | 83/13 |
| 2004/0020384 | A1 * | 2/2004 | Sauer et al. | 101/226 |
| 2005/0034578 | A1 | 2/2005 | Brandenburg et al. | |
| 2005/0039622 | A1 | 2/2005 | Brandenburg et al. | |
| 2005/0061189 | A1 | 3/2005 | Brandenburg et al. | |
| 2005/0247220 | A1 | 11/2005 | Brandenburg et al. | |

FOREIGN PATENT DOCUMENTS

| | | |
|---|---|---|
| DE | 35 01 389 | 7/1986 |
| GB | 2 272 402 | 5/1994 |

* cited by examiner

METHOD AND DEVICE FOR REGULATING THE CROP MARK FOR A ROLLER PRINTING MACHINE WITH MULTI-WEB OPERATION

PRIORITY CLAIM

This is a US national stage of application No. PCT/EP2004/008751, filed on 4 Aug. 2004. Priority under 35 USC. 119(a) and 35 USC. 365(b) is claimed from German Application No. 103 35 886.2, filed 6 Aug. 2003.

BACKGROUND OF THE INVENTION

1. Field of the Invention

The invention relates to a method and an apparatus for controlling the cut register in a web-fed rotary press with multi-web operation.

2. Description of the Related Art

In web-fed rotary presses, it is known to use an actuating roll which can be moved in linear guides as an actuating element for the cut register control, with which roll the paper path length between two draw units is changed and therefore the register is corrected. Register rolls of this type are shown, for example, in DE 85 01 065 U1. The adjustment is generally carried out by means of an electric stepping motor. Apparatuses of this type are afflicted with a relatively high mechanical and electrical complexity, and the control is relatively slow and inaccurate.

SUMMARY OF THE INVENTION

It is an object of the invention to provide a quick and accurate method of controlling the cut register in multi-web operation.

In the method according to the invention for controlling the cut register, the running time of the web image points in a constant web path is adjusted whereas, in the prior art, a change is made in the web length at constant web speed. In the method according to the invention for controlling the web tension at the same time, the leads (speeds) of clamping points are changed, both actions occurring simultaneously and ensuring stable overall control as a result of decoupling measures. Hitherto, this was not possible in the prior art.

It is significant that it is now possible to control cut register errors and web tensions in the same or in different sections of the press simultaneously and independently of one another, this being possible in particular even in the case of the individual part webs within the turner superstructure.

The solution according to the invention requires no additional mechanical web guide element in the form of an actuating roll. For the purpose of cut register correction, existing, non-printing draw units are used, such as the cooling unit, pull rolls in the folder superstructure, the former roll or further draw units located in the web course between the last printing unit and knife cylinder, which are preferably driven by means of individual variable-speed drives. The parameters entering the cut register control section are largely independent of the properties of the rotary press. Furthermore, the cut register accuracy and the control speed (on-control and off-control time) can be increased substantially by the new method, whereby the number of waste copies is considerably reduced.

It is significant that, to control the cut register $Y_{18}$ (cf. FIG. 2 to 9) in multi-web operation, specific image information or measuring marks from printed webs are registered by means of sensors and are supplied to a control device. An item of image information or measuring marks from at least one of the webs, the information or marks being suitable for the deviation of the position of the printed image with respect to its intended position, based on the location and time of the cut, i.e. for the cut register error, is measured before or on the common knife cylinder with the aid of at least one sensor and is available for the control of the total register error of all the webs. The actual value used for the control of the total cut register error of all the webs is either the directly measured register error of the at least one web or, from this register error, an average for the total cut register error of all the webs being calculated or estimated. To correct the total register error of all the webs, either the speed of at least one clamping point located before the knife cylinder and/or the position of the knife cylinder is changed, so that the total register error of all the webs is corrected to the predefined set point in accordance with the actual value.

To calculate or estimate the actual value needed for the control of the total register error of all the webs, either at least one mathematical model and/or measured and stored data are used, the mathematical models being implemented in a computing and/or control device as filters, observers, etc. and/or as curves, tables and characteristics in the form of algorithms and/or data. It is significant that the method can be applied both in part-width and full-width webs or a combination of part-width and full-width webs, in particular of web bundles.

It should be emphasized that at least one web tension $F_{k-1,k}$ to be controlled of at least one of the webs is measured at or before a clamping point k ($K_k$), the clamping point k ($K_k$) being located before the knife cylinder, and that this web tension $F_{k-1,k}$ and at least one part register error $Y_{1i}$* are set independently of each other, that is to say are decoupled in the control engineering sense, by means of suitable manipulated variables from clamping points—the manipulated variables used being circumferential speeds of non-printing clamping points and/or angular positions of printing clamping points and/or a mass flow supplied to the system, which is set by the circumferential speeds of winding devices with the aid of dancer rolls or self-aligning rolls or tension control loops—by means of control loops using appropriate set points $Y_{1iw}$*, $F_{k-1,k,w}$, so that the web tension assumes its set point, which lies in a prescribed range, and the cut register error is corrected to its predefined set point. The actual value for the control of the total cut register error of all the webs is determined either from at least one web or from at least one web bundle or from all the webs.

In order to influence part register errors and the total register error with the aid of the speeds (leads) or angular positions of clamping points, control loops are provided, in particular in a cascade structure. The motors of the driven clamping points are equipped with a current control loop, an angular velocity control loop and possibly an angle control loop. In at least one of the webs, a part register $Y_{13}$* error at a clamping point 3 ($K_3$) is always controlled by a controller, to which the angular velocity control loop and, if present, the angle control loop of the clamping point 3 ($K_3$) are subordinated (cf. FIG. 2 to 9). The control of the total cut register error $Y_{18}$ of all the webs is carried out either with the aid of the change in the position of the knife cylinder, by means of a register control loop assigned to the latter, to which an angle control loop and a rotational speed control loop are subordinated, or the former roll or other suitable additional clamping points perform the correction of the total cut register error with the aid of their circumferential speeds. The actual values used are either the register errors of the individual webs or web bundles measured before or on the knife cylinder or an average calculated from these. A further register control loop can be superimposed on the register control loop of the clamping point 3.

The invention also relates to an apparatus for implementing the method for controlling the cut register on a rotary press, whose clamping points $K_1$ to $K_8$ can be driven independently of one another by drive motors with associated current control, rotational speed control and, if appropriate, angle control, and in which the cut register $Y_{18}$ and/or further part register deviations $Y_{13}$*, $Y_{1i}$*, $Y_{ik}$* associated with this can be registered before or on a knife cylinder $K_8$ and/or before or at one or more clamping points $K_1$ to $K_6$, $K_i$, $K_k$ arranged before this knife cylinder $K_8$ via a specific item of image information or measuring marks of the printed webs by means of at least one sensor, the web tensions $F_{jk}$ can be registered by means of at least one further sensor and these register deviations $Y_{13}$*, $Y_{1i}$*, $Y_{ik}$* and web tensions $F_{jk}$, registered by the sensors, for influencing the cut register error $Y_{18}$ can be supplied to a closed-loop and/or open-loop control device for changing angular positions or circumferential speeds $v_1$ to $v_8$, $v_i$, $v_k$ of the respective clamping point $K_1$ to $K_8$, $K_i$, $K_k$, it being possible to set the web tensions $F_{jk}$ in a web section j-k and the register errors $Y_{1i}$* in another or the same web section independently of one another by means of appropriate set points $F_{jk,w}$, $Y_{1i,w}$*, for which purpose a man-machine interface, in particular a control desk, with appropriate visualization is provided. The unwinds ($K_0$) can be controlled by means of dancer rolls or web tension control loops in such a way that, by means of their circumferential speeds, with the aid of dancer rolls or web tension control loops, the unsteady and steady mass flow introduced into the relevant system can be changed.

It is necessary that, at the nominal speed of the press, the sensors and associated evaluation devices make the information about the register error or errors $Y_{18}$; $Y_{13}$*; $Y_{1i}$*; $Y_{1k}$* and the web tension $F_{jk}$ available in the minimum time and are designed with interfaces which transmit the register errors $Y_{18}$; $Y_{13}$*; $Y_{1i}$*; $Y_{1k}$* and the web tensions $F_{jk}$ via field buses, Ethernet or other communication buses or communication interfaces.

The closed-loop and/or open-loop control devices are implemented as a central computer, preferably in the control desk, or as an embedded computer, preferably in open-loop or closed-loop control cabinets, or are implemented in functionally decentralized form in the respective converter devices, and all the information (actual values, set points, control algorithms) are processed in real time.

The invention is to be explained in more detail in the following text using some exemplary embodiments.

FUNCTIONAL DESCRIPTION

DETAILED DESCRIPTION OF THE PRESENTLY PREFERRED EMBODIMENTS

Figure 1:
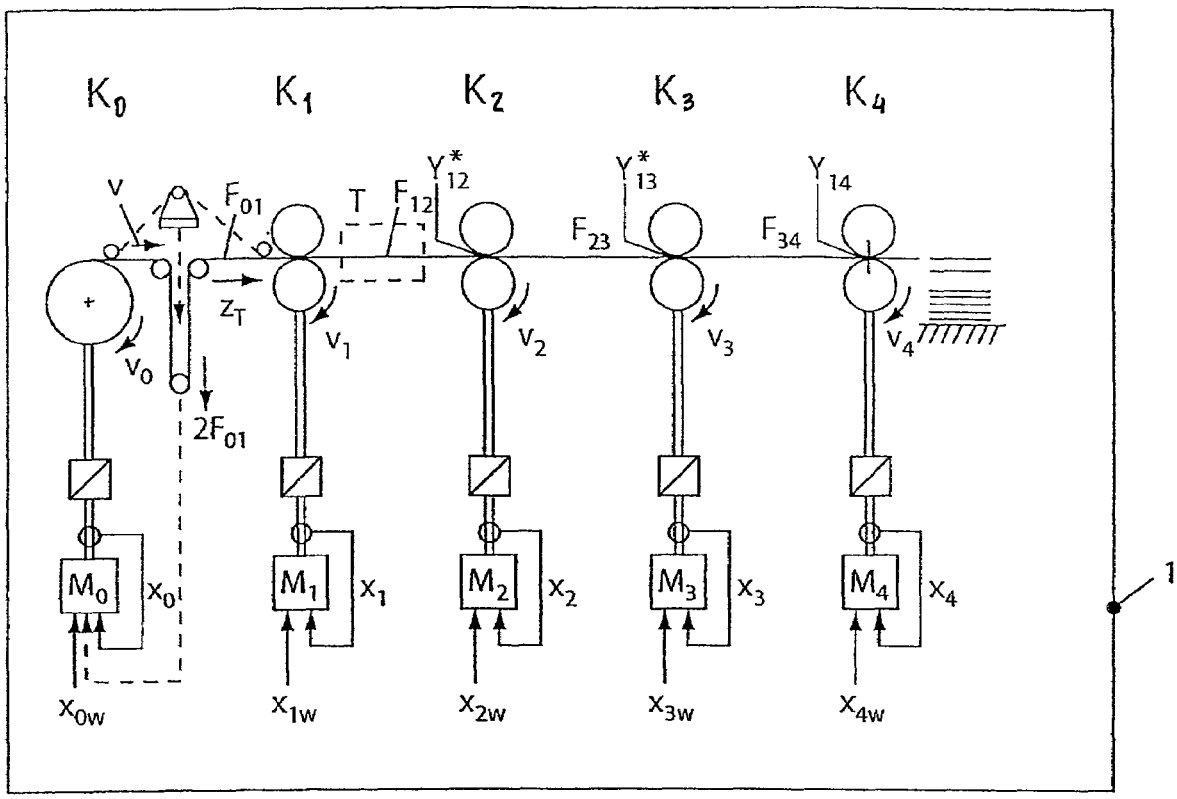
FIG. 1 shows a clamping point diagram of a rotary press with controlled drives.

In multi-web operation of web-fed presses, the case occurs in which a greater or lesser number of webs, part webs (strands) or web bundles composed of these are led together and have to be cut by a common knife cylinder. It is conceivable in general for each web strand or each web bundle to be equipped with an unwind, a threading apparatus, with printing units and following transport and processing clamping points. Thus, decoupled control of the part cut register and of the web tensions in each of the webs can be carried out in a manner analogous to the method steps described in Patent Application Publication Nos. US 2005/0061189 and US 2005/0039622, which are incorporated herein by reference. The object is, then, to monitor the total cut register error of all the webs on the common knife cylinder and as far as possible to set it to the predefined value, for example equal to zero. Such general systems are present above all in newspaper presses, possibly also in illustration machines, if web bundles originating from various former systems are to be cut by a common knife cylinder in register.

First of all, a single web-fed press will be assumed, in which a full-width web upstream of a turner unit is to be cut, led onwards in the form of part webs (strands), bundled on a former roll, folded in the longitudinal direction in the former and cut by a common knife cylinder. The web bundle is characterized in that, normally, the strand located at the top upstream of the former roll surrounds the longitudinally folded webs. This will be assumed in the following text. Otherwise, the statements for the upper and lower web must be changed with the same effect. The object is to minimize the total cut register error of the web bundle. An increase in the cut register accuracy by controlling a part cut register error $Y_{1i}$* of the full-width web measured before the turner unit is possible and very advantageous, but not satisfactory since the web strands are subjected to further disturbances, which lead to new register errors, on their path over deflection rods and guide rolls as far as the former roll. The web strands led together are additionally subjected to different forces as they run through the former as far as the knife cylinder, so that they experience displacement with respect to one another, which leads to different and possibly not tolerable total cut register errors. Therefore, in the event of higher accuracy requirements, additional measures for cut register correction have to be taken.

The invention will be described initially using the example of two part-width webs (strands BU, BO) guided over a folding former 7 (system 1 to 7 according to FIG. 2 to 8). However, the invention is not intended to be restricted to just this application, for it is also possible for any number of web strands, as are indicated in FIGS. 2 and 3, 8 and 9 as further web BE, but have been omitted from the other figures for reasons of clarity, and in general a plurality of web bundles to be involved (cf. FIG. 9)

1. Plant Diagram

The four-roll system of FIG. 1 is a simplified form of a rotary press, in particular a web-fed offset press. All the printing units are combined in a clamping point 1 ($K_1$) following the unwind, clamping point 0 ($K_0$). Between clamping point 0 ($K_0$) and 1 ($K_1$) there is a dancer roll or tension control loop for predefining the web tension $F_{01}$ as an abbreviated representation of the device for setting the web tensions after the unwind and in the threading mechanism. In the case of an illustration press, clamping point 2 ($K_2$) stands for the cooling unit, in between there is possibly a dryer T, clamping point 3 ($K_3$) stands for the turner unit and clamping point 4 ($K_4$) for the folding unit with the knife cylinder determining the cut. The system located after the clamping point 3 ($K_3$) is illustrated in more detail in FIG. 2 to FIG. 8. The variables $v_i$ are the circumferential speeds of the clamping points $K_i$, which should be approximated by the behaviour of wrapped rolls with Coulomb friction. In the case of rotary presses, instead of the term "speed", the term "lead" is used. The lead $W_{i,i-1}$ of a clamping point i ($K_i$) with respect to a clamping point i-1 ($K_{i-1}$) is given by the expression $$W_{i,i-1} = \frac{v_i - v_{i-1}}{v_{i-1}}$$

In the following text, "speed" and "lead" will be used synonymously. The web force in a section i-1, i will be designated $F_{i-1,i}$. The changes in the modulus of elasticity and in the cross section of the web running in are combined in $Z_T$.

In order to control the cut register, specific image information or measuring marks are registered by means of at least one sensor and supplied to a control device. Let the total cut register error $Y_{18}$ be measurable before or on the knife cylinder on the upper, surrounding web (sensor SO, cf. FIG. 2) and be available as an actual value for the control of the cut register error of the web bundle. Let the register error $Y_{14}$ or $Y_{18}$, i.e. in general $Y_{1n}$ on the clamping point n ($K_n$) the knife cylinder, (cf. FIG. 2 to FIG. 8) be designated the total cut register error or, in brief, the cut register error. A register error $Y_{1i}$* which has occurred previously, measured at a non-printing clamping point i, will be called the part cut register error, in brief, part register error.

A part cut register error $Y_{1i}$*, measured at the clamping point i ($K_i$) or between two clamping points i-1 ($K_{i-1}$*) and i ($K_i$), is the positional deviation of a point printed by the clamping point 1 from the measurement location in the case of non-steady-state movement at a time at which it would reach this measurement point in the event of steady-state movement. This definition is a time-continuous variable. This results specifically in the deviation of the intended cut line at the measurement location as a time-discrete variable. The total cut register error $Y_i$ is the deviation of the cut line located between two printed images from its correct position in relation to the cutting time of the clamping point n ($K_n$), as based on the clamping point 1 ($K_1$).

The system of FIG. 1 will be viewed as a mechanical control system with associated actuating elements (controlled drives). The two control variables are, for example, the part cut register error $Y_{13}$* and the web tension $F_{23}$. Manipulated variables are the lead of the clamping point 3 ($K_3$) and the lead or position of the clamping point 1 ($K_1$). By means of appropriate control loops, the intention is for these variables to be predefinable independently of one another in accordance with set points. The actuating elements are formed by the controlled drive motors $M_1$ to $M_4$ (cf. FIG. 1) or $M_1$ to $M_8$ (cf. FIG. 2). The input variables $x_{iw}$ shown in FIG. 1 stand for the angular velocity (rotational speed) or angle set points of the controlled drives $M_1$ to $M_4$.

Figure 2:
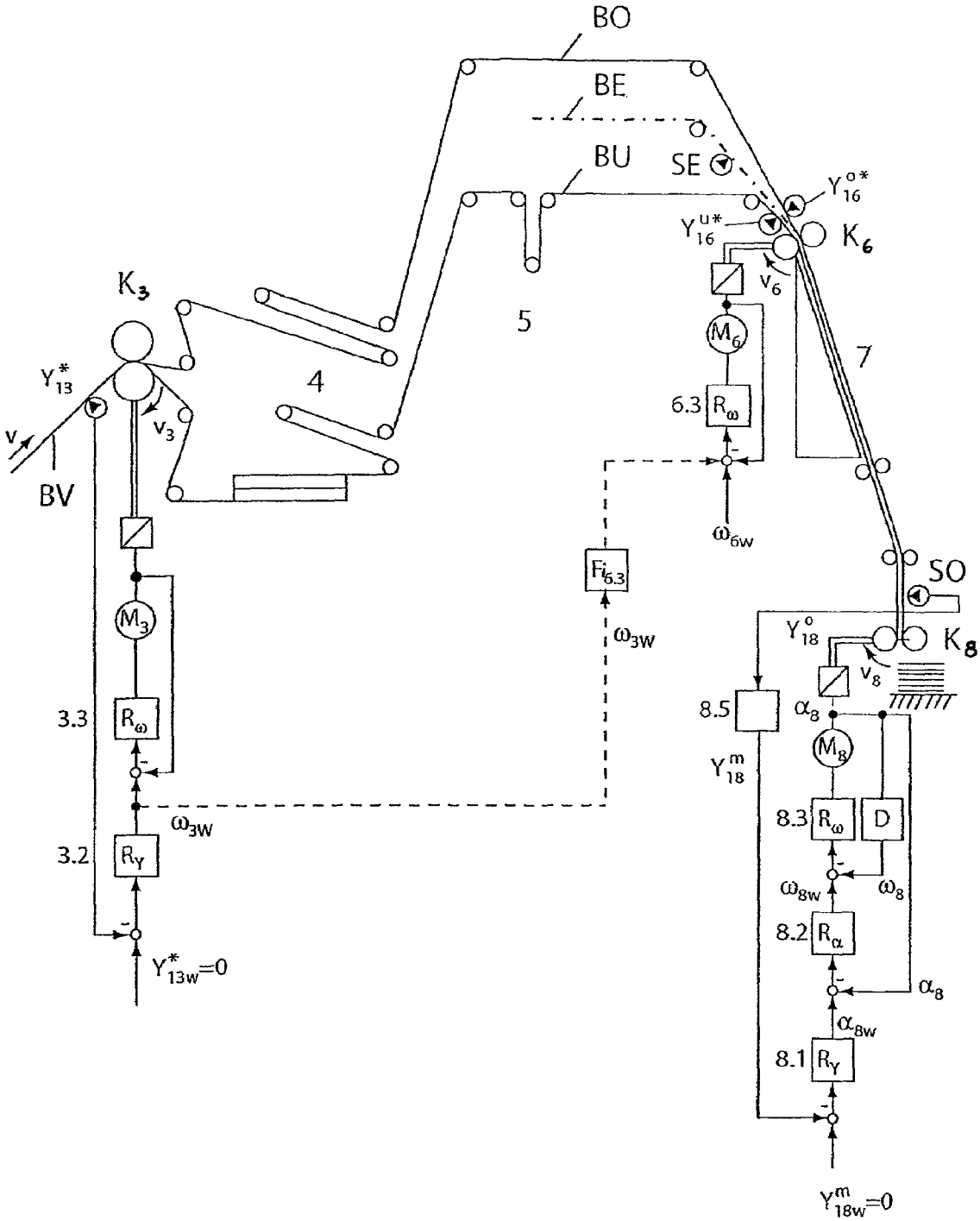
FIG. 2 shows an arrangement for controlling the cut register in multi-web operation, system 1.

In the following text, the numbering of the clamping point 3 ($K_3$) as the first clamping point of the turner unit will be maintained. FIG. 2 (System 1) begins, as do all those following, with the clamping point 3 ($K_3$), and the further plant configuration as far as the knife cylinder is illustrated as a basic appliance plan. Shortly before the clamping point 3, the full-width web BV is cut longitudinally into two web strands BO and BU. The strands (BO, BU) are led together in the former roll 6 after passing through the folding unit 4. Further webs BE can run into the former roll 6. The actuating roll 5 is used for the cut register presetting of the lower part web. The two webs led together run through the former 7 and the following turner rolls as far as the knife cylinder 8. After cutting and folding, the finished copies leave the press. The clamping points 3 ($K_3$) and 6 ($K_6$) should be driven by electric drives which are controlled in terms of current and rotational speed (angular velocity). They can also additionally be equipped with a higher-order angle controller. In particular, the drive of the clamping point 8 ($K_8$) has its current, rotational speed and angle controlled.

It will be assumed that it is advantageous to control the register error $Y_{13}$* of the full-width web before the turner unit to the prescribed set point $Y_{13w}$*, for example $Y_{13w}$*=0, with a register control loop superimposed on the rotational speed control loop. Therefore, the register error which has occurred before this measurement point is eliminated. All further measures build on this structure.

2. Systems Having a Folding Former

System 1: Register control on the knife cylinder as described in Patent Application Publication No. US 2005/0034578, which is incorporated herein by reference (FIG. 2).

The cut register error is measured immediately before the knife cylinder 8 and is corrected by the angular position of the knife cylinder 8. It should be possible to determine the error $Y_{18}^{o}$ of the upper web. For this purpose, the register error $Y_{18}^{o}$ is measured shortly before or on the knife cylinder 8 with the aid of the sensor SO, supplied via the block 8.5 to the comparison point of a cut register controller 8.1 and compared with a predefined set point $Y_{18w}^{m}$, for example $Y_{18w}^{m}$=0. The register controller prescribes a position set point $\alpha_{8w}$ for the angle controller 8.2. The rotational speed control loop (controller 8.3) and current control loop (not illustrated) are subordinated to this. The numerical differentiator D forms the actual value of the angular velocity $\omega_8$ from the actual angle value $\alpha_8$. In the case of this design, control is carried out either of the total cut register error $Y_{18}^{o}$ or of the average $Y_{18}^{m}$, which is calculated in block 8.5 (average former). By forming an average, which is predominantly based on empirical results, the different register positions of the web strands are taken into account in the case of multi-web operation.

If a cut register error occurs, for example in the event of a reel change, the register error $Y_{18}^{o}$ or $Y_{18}^{m}$ is compensated for in accordance with the dynamics of the subordinate angle control loop. Because of the measurement located immediately before the knife cylinder, the run times are minimal. Extremely short control times can be achieved with the individual drive of the knife cylinder 8.

The possibility is provided of adding a corrective movement of the clamping point 3 ($K_3$), that is to say the associated change in the angular velocity $\omega_{3w}$, to the angular velocity set point $\omega_{6w}$. This measure is used for the preliminary control of the clamping point 6 ($K_6$) in order to eliminate, partly or wholly, the web time constant between clamping points 3 ($K_3$) and 6 ($K_6$). A filter $F_{6.3}$ takes into account empirically obtained modifications of the preliminary control, which, for example, can be caused by sliding slippage of the clamping point 6 ($K_6$).

If only the errors $Y_{16}^{o*}$ and $Y_{16}^{u*}$ before the former roll 6 can be measured, that is to say not on the knife cylinder 8, then, in the case of two-web operation, control is carried out to the mean $Y_{16}^{m*}=(Y_{16}^{u*}+Y_{16}^{o*})/2$ of these two errors or, in the case of multi-web operation, to an empirically determined mean $Y_{16}^{m*}$, from which, if appropriate, an estimated error $Y_{18}^{m}$ can also be determined, which can serve as an equivalent value for the error $Y_{18}^{m}$.

The actuating roll 5 is used for presetting the cut register $Y_{18}^{u*}$ of the lower web BU. There is no possibility of influencing the upper and lower web separately through the angular position of the knife cylinder alone, since only a single drive is available for the correction. For this purpose, the actuating roll 5 would additionally have to be equipped with a high-performance, dynamically quick and position-controlled servo drive.

Figure 3:
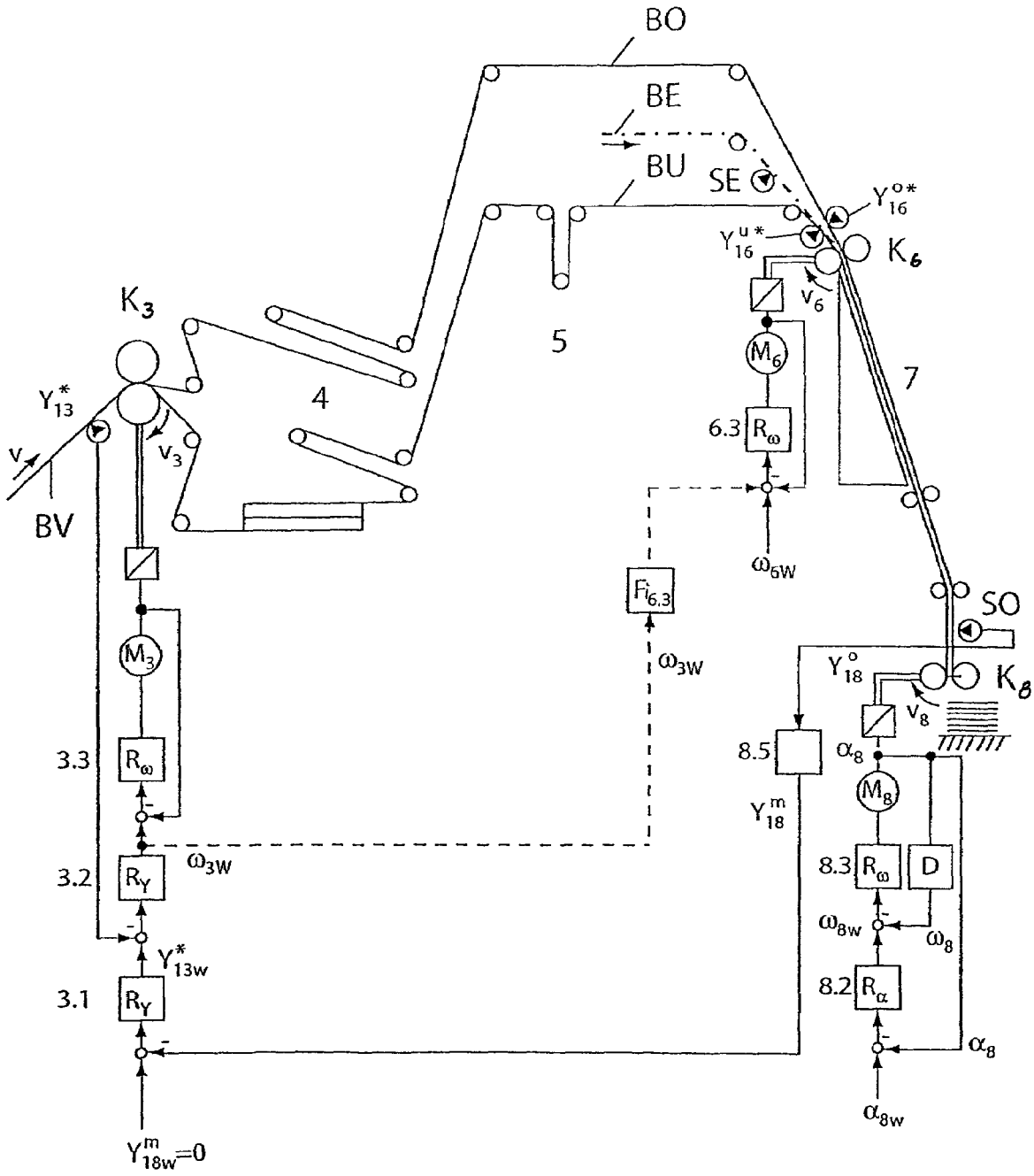
FIG. 3 shows an arrangement for controlling the cut register in multi-web operation, system 2.

System 2: Register measurement on the knife cylinder with the subordination of the part register error on the turner unit, as described in the prior Patent Application PB04637 (FIG. 3).

The knife cylinder has only angle control. To control the cut register, the clamping point 3 ($K_3$) with its drive already present is used. The register $Y_{18}^{o}$ or $Y_{18}^{m}$ is superimposed on the register control loop for $Y_{13}^{*}$. If the register errors can be measured only before the clamping point 6 ($K_6$), then control is carried out to the average $Y_{16}^{m*}=(Y_{16}^{u*}+Y_{16}^{o*})/2$ of these two errors or, in the case of multi-web operation, to an empirically determined average $Y_{16}^{m*}$, from which, is appropriate, an estimated error $Y_{18}^{m}$ can also be determined, which can be used as an equivalent value for the error $Y_{18}^{m}$.

In the case of an incoming disturbance, for example in the event of a reel change, the subordinated register control loop for $Y_{13}^{*}$ (controller 3.2) performs a fast pre-correction, while the register error for $Y_{18}^{o}$ or $Y_{18}^{m}$ (controller 3.1) tracks the set point $Y_{13,w}^{*}$ in accordance with the register error $Y_{18}^{o}$ measured on the knife cylinder 8, so that the prescribed set point $Y_{18,w}^{m}$, for example $Y_{18,w}^{m}=0$, is reached. The error $Y_{16}^{m*}$ can also occur instead of $Y_{18}^{o}$.

The possibility is provided of adding a corrective movement of the clamping point 3 ($K_3$), that is to say the associated change in the angular velocity $\omega_{3w}$, to the angular velocity set point $\omega_{6w}$. This measure is used for the preliminary control of the clamping point 6 ($K_6$) in order to eliminate, partly or wholly, the web time constant between clamping points 3 ($K_3$) and 6 ($K_6$). A filter $Fi_{6.3}$ takes into account empirically obtained modifications of the preliminary control, which, for example, can be caused by sliding slippage of the clamping point 6 ($K_6$).

This method is combined with the slow readjustment of the angular position of the printing units described in Patent Application Publication No. US 2005/0034578, in order to avoid excessively large leads, or with the combined tension-register control as disclosed in Patent Application Publication Nos. US 2005/0061189 or US 2005/0039622.

System 3: Register control loop for the cut register error $Y_{18}^{o}$ and control loop for the difference $Y_{18}^{d*}$ of the part cut register errors, as described in the prior Patent Application PB04637 (FIG. 4).

Figure 4:
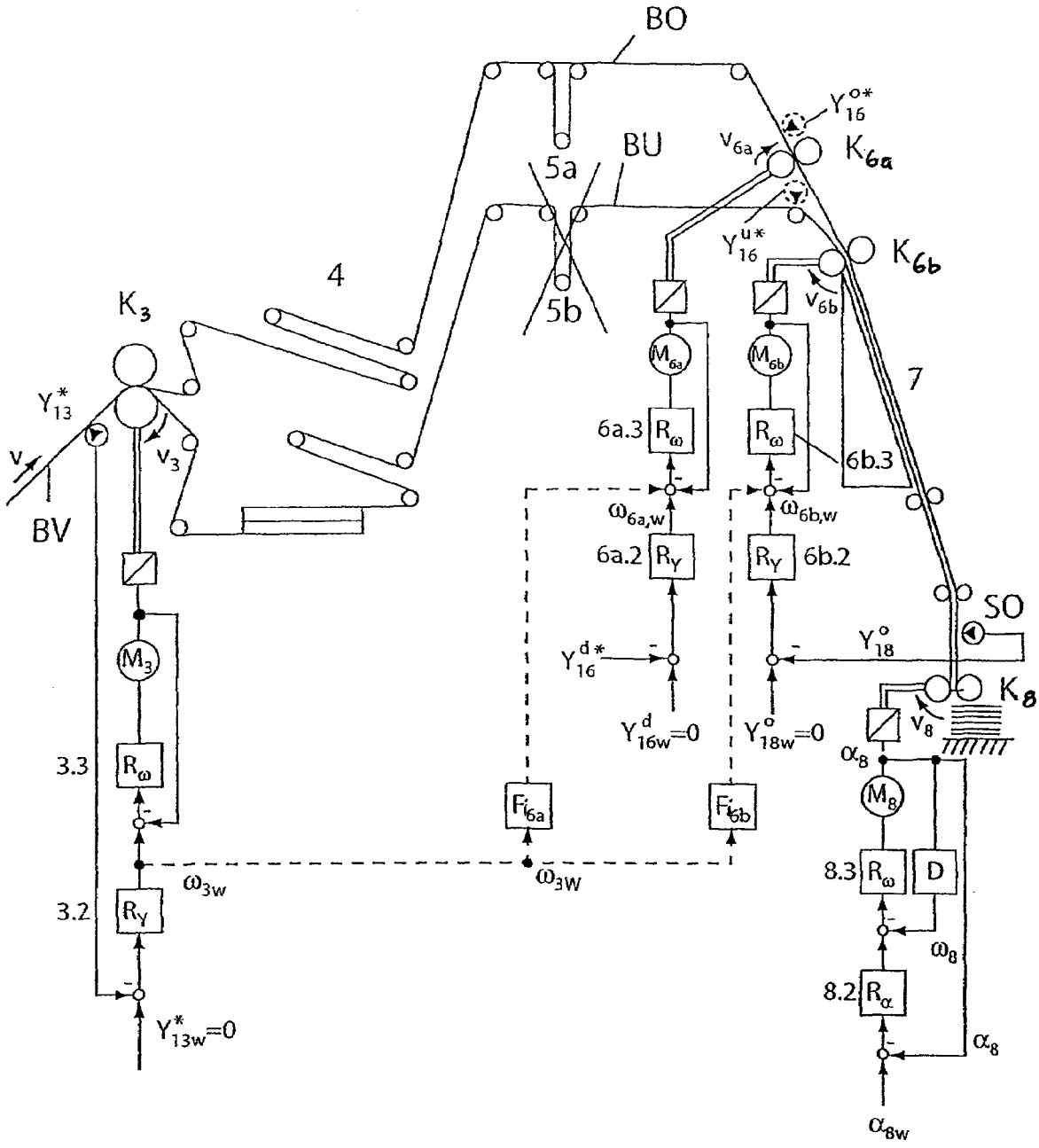
FIG. 4 shows an arrangement for controlling the cut register in multi-web operation, system 3.

The register error $Y_{18}^{o}$ of the upper web BO is measured immediately before the knife cylinder 8 and is supplied to a cut register controller 6*b*.2, whose manipulated variable is the angular velocity $\omega_{6b,w}$ of the former roll 6*b* (FIG. 4). Using this lead, the cut register of the two webs is influenced simultaneously in accordance with $Y_{18,w}^{u}$. In order to control out an offset between the two webs BU, BO, in addition the register error $Y_{16}^{o*}$ of the upper web BO and $Y_{16}^{u*}$ of the lower web is measured before the clamping point 6 ($K_6$) and the difference $Y_{16}^{d*}=Y_{16}^{u*}-Y_{16}^{o*}$ is calculated. This is supplied to a cut register difference controller 6*a*.2, whose manipulated variable is the angular velocity $\omega_{6a,w}$ of an additional clamping point 6*a* ($K_{6a}$) of the upper web BO before the former roll. This clamping point 6*a* ($K_{6a}$) is equipped with a controlled-current and controlled-speed drive, possibly with superimposed angle control. The actuating roll 5*a* is conceived only for the coarse presetting of the cut register of the upper web BO and will seldom be actuated. An actuating roll 5*b* can be dispensed with.

In the case of an incoming disturbance, for example in the event of a reel change, the subordinated register control loop for $Y_{13}^{*}$ (controller 3.2) performs a fast pre-correction of the full-width web, and the register controller for $Y_{18}^{o}$ (controller 6*a*.2) corrects both the webs in accordance with the set point $Y_{18w}^{o}$. The register controller for $Y_{16}^{d*}$ (controller 6.*a*2) controls out the difference $Y_{16}^{d*}=Y_{16}^{o*}-Y_{16}^{u*}$ between upper web BO and lower web BU to the set value $Y_{16}^{d*}$=const in particular to the value $Y_{16}^{d*}=0$.

Instead of the speed (lead) of the additional clamping point 6*a* ($K_{6a}$), the position of an actuating roll 5*a* can also occur. For this purpose the latter would have to be equipped with a high-performance, dynamically quick and position-controlled servo drive.

In this solution, the cut register $Y_{18}^{o}$ of the upper web and $Y_{16}^{u}$ of the lower web can be influenced. The clamping point 6*a* ($K_{6a}$) is designed either with a full-width pressing roll or with trolleys and additional wrap, which means that this is a complete and almost slip-free clamping point. In the case of the former roll 6*b*, the clamping is carried out with trolleys, because of the plurality of webs to be transported. The force difference which can be transmitted is therefore restricted and is affected by slippage, above all in the event of fast lead changes.

It is pointed out that, by using the clamping point 6*b* ($K_{6b}$), instead of $Y_{18}^{o*}$, $Y_{16}^{d*}$ can also be controlled, and, by using the clamping point 6*a* ($K_{6a}$), instead of $Y_{16}^{d*}$, $Y_{18}^{o}$ can also be controlled, that is to say the assignment of clamping points and controlled variables can be interchanged.

The possibility is provided of adding a corrective movement of the clamping point 3 ($K_3$), that is to say the associated change in the angular velocity $\omega_{3w}$, to the angular velocity set points $\omega_{6,aw}$ and $\omega_{6,bw}$, it being necessary for adaptation filters $Fi_{6a}$ and $Fi_{6b}$ to be used. They are used firstly as symmetry filters, as described in Patent Application Publication No. US 2005/0061189, and may permit empirically obtained modifications of the preliminary control. This measure is used for the preliminary control of the clamping point 6*a* ($K_{6a}$) and 6*b* ($K_{6b}$) in order to eliminate, partly or wholly, the web time constant between clamping points 3 ($K_3$) and 6 ($K_{6a,b}$).

If it is not possible to measure the register error of the upper web BO directly before the knife cylinder 8, they are measured before the former roll and $Y_{16}^{o}$ occurs at this point.

This method is combined with the slow readjustment of the angular position of the printing units, described in Patent Application Publication No. US 2005/0034578, in order to avoid excessively large leads, or with the combined tension-register control in accordance with Patent Application Publication Nos. US 2005/0061189 or US 2005/0039622.

Figure 5:
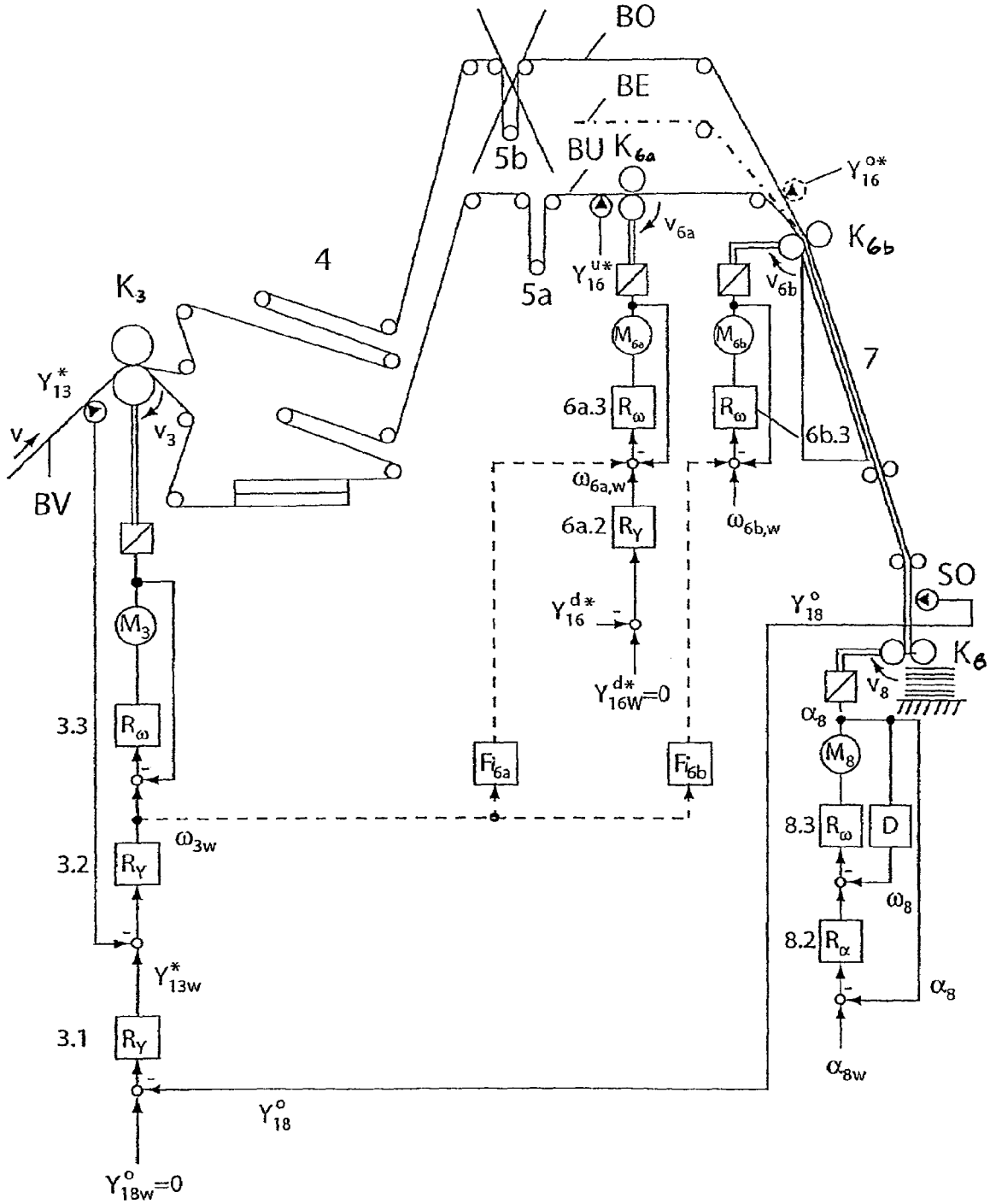
FIG. 5 shows an arrangement for controlling the cut register in multi-web operation, system 4.

System 4: Control loop for the cut register error $Y_{18}^{o}$ of the upper web with subordinated control loop for $Y_{13}^{*}$ and also control loop for the difference $Y_{16}^{d*}$ of the part cut register errors (FIG. 5)

In this system, it is not the former roll but the clamping point 3 ($K_3$) which performs the correction to the cut register error $Y_{18}^{o}$ of the surrounding upper web.

In the case of an incoming disturbance, for example in the event of a reel change, the controller 3.2 for the register error $Y_{13}^{*}$ performs a fast pre-correction of the full-width web. With the aid of a superimposed control loop (controller 3.1), this set point is tracked in accordance with $Y_{18w}^{o}$=const, in particular $Y_{18w}^{o}=0$ and therefore the upper web BO is set to the correct cut register while at the same time influencing the lower web BU. Using the additional clamping point 6*a* ($K_{6a}$), the register difference $Y_{16}^{d*}=Y_{16}^{o*}-Y_{16}^{u*}$ between upper web BO and lower web BU is readjusted in accordance with the difference set point $Y_{16w}^{d}$=const, in particular $Y_{16w}^{d}=0$ by the controller 6*a*.2. In this case, the part cut register errors are measured before the clamping points 6*a* and 6*b* ($K_{6a}$ and $K_{6b}$). However, the difference $Y_{18}^{d*}=Y_{18}^{o}-Y_{16}^{u*}$ can also be formed and this can be controlled. The most beneficial solution must be determined empirically.

In this solution, two complete clamping points are advantageously used, since the former roll lead, with its force transmission affected by slippage, is no longer a manipulated variable.

The possibility is provided of adding a corrective movement of the clamping point 3 ($K_3$), that is to say the associated change in the angular velocity $\omega_{3w}$, to the angular velocity set points $\omega_{6a,w}$ and $\omega_{6b,w}$, it being necessary for adaptation filters $Fi_{6a}$ and $Fi_{6b}$ to be used. They are used firstly as symmetry filters, as described in Patent Application Publication No. US 2005/0061189, and may permit empirically obtained modifications of the preliminary control. This measure is used for the preliminary control of the clamping points 6*a* ($K_{6a}$) and 6*b* ($K_{6b}$) in order to eliminate, partly or wholly, the web time constant between clamping points 3 ($K_3$) and 6 ($K_{6a,b}$).

Instead of the speed (lead) of the additional clamping point 6*a* ($K_{6a}$), the position of an actuating roll 5*a* can occur. For this purpose, the latter would have to be equipped with a high-performance, dynamically quick and position-controlled servo drive. An actuating roll 5*b* is rendered superfluous.

This method is combined with the slow readjustment of the angular position of the printing units, described in Patent Application Publication No. US 2005/0034578, in order to avoid excessively large leads, or with the combined tension-register control in accordance with Patent Application Publication Nos. US 2005/0061189 or US 2005/0039622.

System 5: Control loops for the cut register error $Y_{16}^{u*}$ of the lower web and $Y_{16}^{o*}$ of the upper web (FIG. 6)

Figure 6:
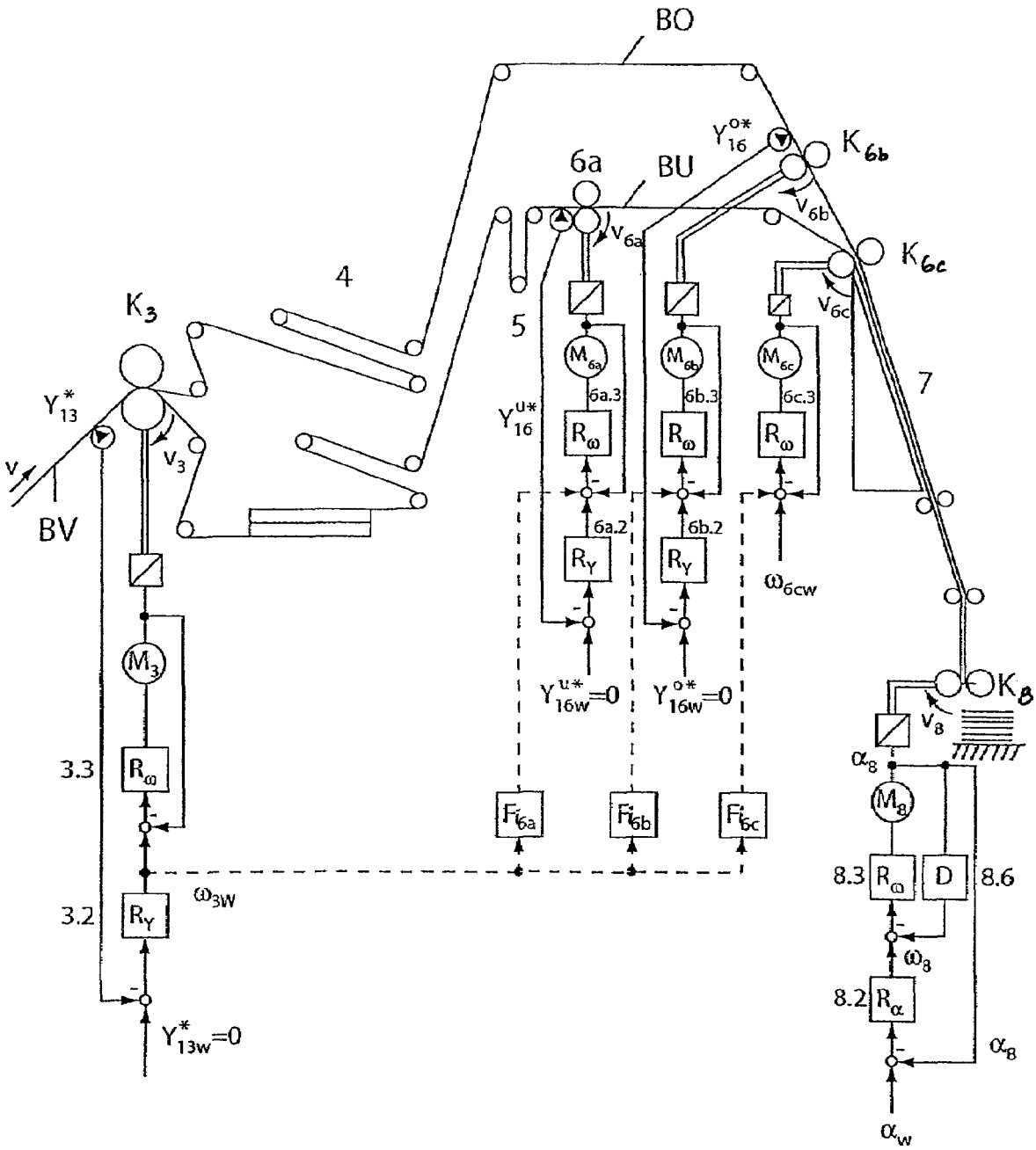
FIG. 6 shows an arrangement for controlling the cut register in multi-web operation, system 5.

For the lower web BU and the upper web BO, a clamping point 6*a* and 6*b* ($K_{6b}$) is provided in each case, by means of which the register errors $Y_{16}^{u*}$ and $Y_{16}^{o*}$ can be corrected separately from each other (FIG. 6). In the case of an incoming disturbance, for example in the event of a reel change, the controller 3.2 for the register error $Y_{13}^{*}$ performs a fast pre-correction of the full-width web. Using the additional clamping point 6*b* ($K_{6b}$), the upper web BO is controlled by the controller 6*b*.2 in accordance with the set point $Y_{16w}^{o*}$. Using the additional clamping point 6*a* ($K_{6a}$) the lower web BU is controlled by the controller 6*a*.2 in accordance with the same set point $Y_{16w}^{u*}=Y_{16w}^{o*}$, so that the difference of the part cut register error between upper web BO and lower web BU becomes zero. It is also possible, similarly to FIG. 5, to control the upper web in accordance with the set point $Y_{16w}^{o*}$ and the lower web in accordance with the difference $Y_{16}^{d*}=Y_{16}^{o*}-Y_{16}^{u*}$, with $Y_{16w}^{d*}$=const, in particular $Y_{16w}^{d*}=0$. The assignment of the clamping points and set points can also be made in mirror-image fashion. The cut register controllers 6*a*.2 and 6*b*.2 are superimposed on the rotational speed control loops (controller 6*a*.3 and controller 6*b*.3).

The clamping points 6*a* ($K_{6a}$) and 6*b* ($K_{6b}$) are advantageously designed either with full-width pressing rolls or with trolleys and additional wrap, which means that these become complete and almost slip-free clamping points. b8

The possibility is provided of adding a corrective movement of the clamping point 3 ($K_3$), that is to say the associated change in the angular velocity $\omega_{3w}$, to the angular velocity set points $\omega_{6a,w}$ and $\omega_{6b,w}$, it being necessary for adaptation filters $Fi_{6a}$ and $Fi_{6b}$ to be used. They are used firstly as symmetry filters, as described in Patent Application Publication No. US 2005/0061189, and may permit empirically obtained modifications of the preliminary control. This measure is used for the preliminary control of the clamping point 6*a* ($K_{6a}$) and 6*b* ($K_{6b}$) in order to eliminate, partly or wholly, the web time constant between clamping points 3 ($K_3$) and 6 ($K_{6a,b}$).

This method is combined with the slow readjustment of the angular position of the printing units, described in Patent Application Publication No. US 2005/0034578, in order to avoid excessively large leads, or with the combined tension-register control in accordance with Patent Application Publication Nos. US 2005/0061189 or US 2005/0039622.

System 6: Control loops for the cut register error $Y_{18}^{o}$ of the upper web and for the cut register error difference $Y_{16}^{d}$ (FIG. 7)

Figure 7:
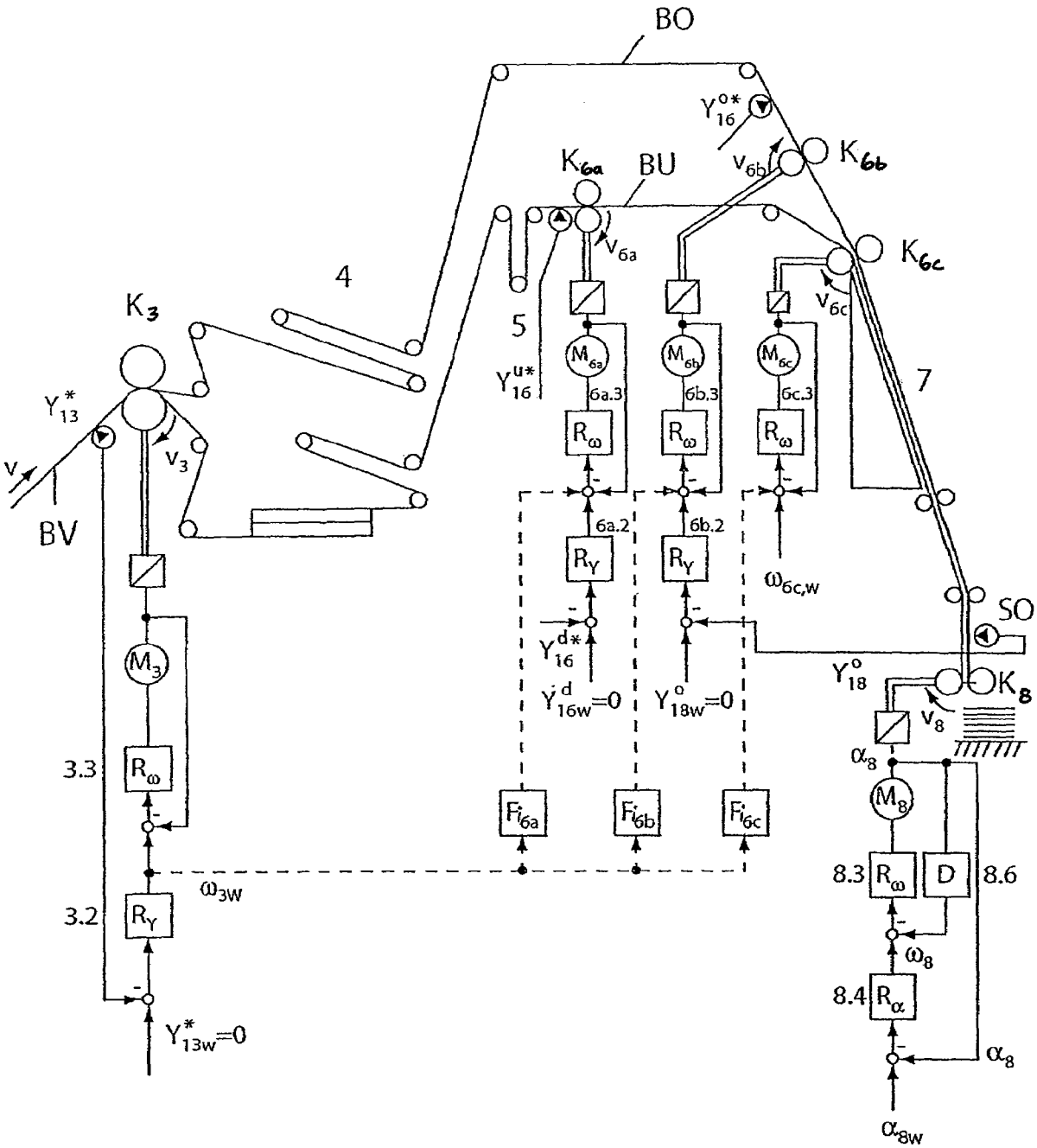
FIG. 7 shows an arrangement for controlling the cut register in multi-web operation, system 6.

For the lower web BU and the upper web BO, a clamping point 6*a* ($K_{6a}$) and 6*b* ($K_{6b}$) is provided in each case, by means of which the cut register error $Y_{18}^{o}$ and the cut register error difference $Y_{16}^{d}$ can be corrected separately from each other (FIG. 7). In the case of an incoming disturbance, for example in the event of a reel change, the controller 3.2 for the register error $Y_{13}^{*}$ performs a fast pre-correction of the full-width web. Using the clamping point 6*b* ($K_{6b}$), the upper web BO is controlled by the controller 6*b*.2 in accordance with the set point $Y_{18w}^{o}$=const, in particular $Y_{18w}^{o}=0$. Using the clamping point 6*a* ($K_{6a}$), the lower web BU is controlled by the controller 6*a*.2 in accordance with the set point $Y_{16w}^{d*}$=const, in particular $Y_{16w}^{d}=0$. However, similarly to System 4, the difference $Y_{18}^{d*}=Y_{18}^{o}-Y_{16}^{u*}$ can also be formed and this can be controlled. The most beneficial solution must be determined empirically. The register controllers 6*a*.2 and 6*b*.2 are superimposed on the rotational speed control loops (controller 6*a*.3 and controller 6*b*.3).

The clamping points 6*a* ($K_{6a}$) and 6*b* ($K_{6b}$) are advantageously designed either with full-width pressing rolls or with trolleys and additional wrap, which means that these become complete and almost slip-free clamping points.

The possibility is provided of adding a corrective movement of the clamping point 3 ($K_3$), that is to say the associated change in the angular velocity $\omega_{3w}$, to the angular velocity set points $\omega_{6a,w}$ and $\omega_{6b,w}$, it being necessary for adaptation filters $Fi_{6a}$ and $Fi_{6b}$ to be used. They are used firstly as symmetry filters, as described in Patent Application Publication No. US 2005/0061189, and may permit empirically obtained modifications of the preliminary control. This measure is used for the preliminary control of the clamping points 6*a* ($K_{6a}$) and 6*b* ($K_{6b}$) in order to eliminate, partly or wholly, the web time constant between clamping points 3 ($K_3$) and 6 ($K_{6a,b}$).

This method is combined with the slow readjustment of the angular position of the printing units, described in Patent Application Publication No. US 2005/0034578, in order to avoid excessively large leads, or with the combined tension-register control in accordance with Patent Application Publication Nos. US 2005/0061189 or US 2005/0039622.

Figure 8:
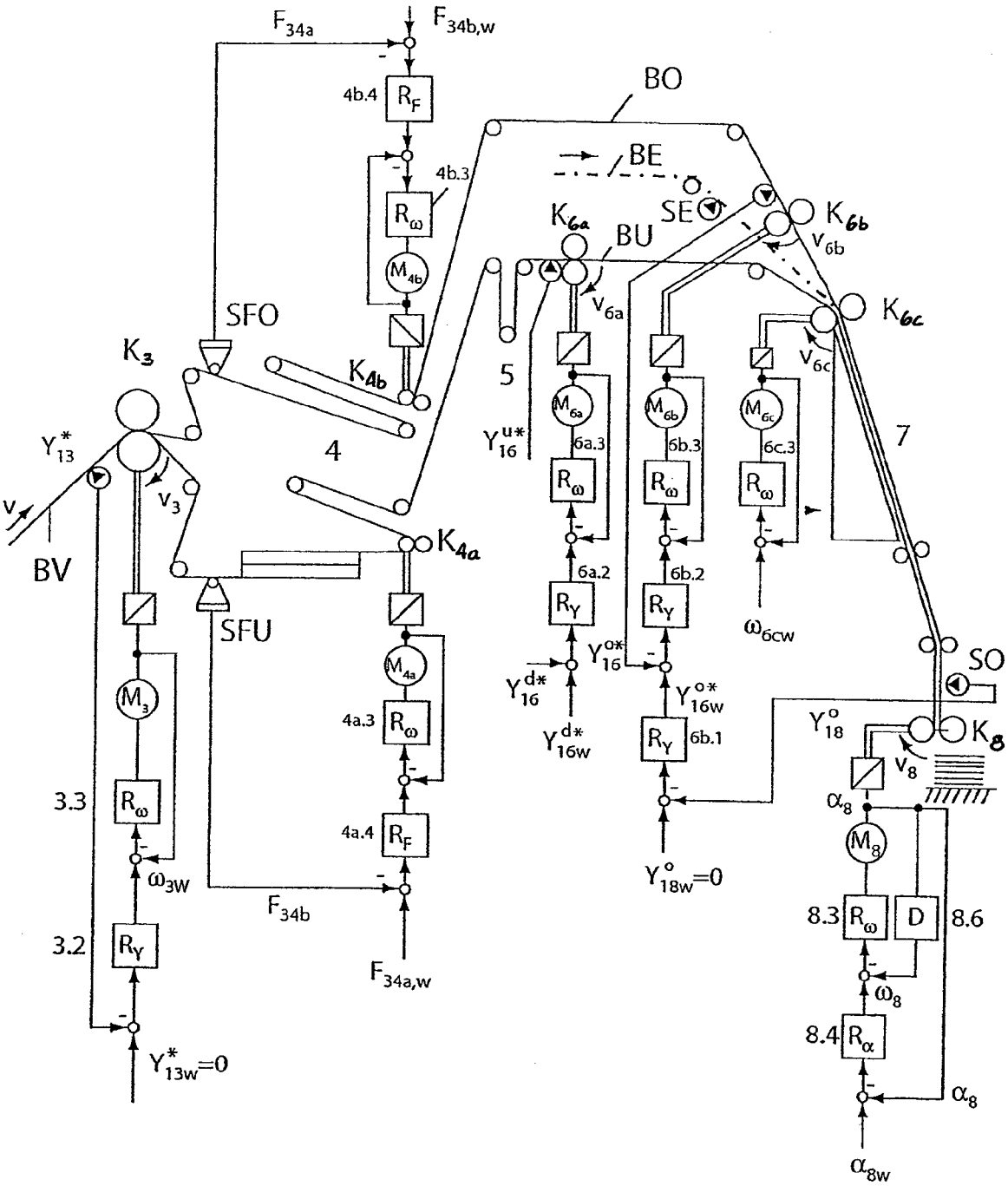
FIG. 8 shows an arrangement for controlling the cut register and a web tension in multi-web operation, system 7.

System 7: Control loops for the total cut register error $Y_{16}^{o*}$ of the upper web and the difference $Y_{16}^{d*}$ part cut register errors with superimposed control loop for the cut register error $Y_{18}^{o}$ of the upper web and additional web tension control loops (FIG. 8)

As compared with System 6, the complete register control loop of clamping point 6*b* ($K_{6b}$) [controller 6*b*.2] for the register error $Y_{16}^{o*}$ now has superimposed on it the register controller 6*b*.1 for the register error $Y_{18}^{o}$. The control of the difference cut register error is identical to that in system 6. In the case of an incoming disturbance, for example in the event of a reel change, the controller 3.2 for the register error $Y_{13}^{*}$ performs a fast pre-correction of the full-width web. If it is possible to measure the incoming disturbance at the clamping points 6*a* ($K_{6a}$) and 6*b* ($K_{6b}$), then the speeds of these clamping points are corrected by the register controllers 6*a*.2 and 6*b*.2 in accordance with the set points $Y_{16w}^{d*}$ and $Y_{16w}^{o*}$. If, finally, the disturbance which has run in can be measured at the sensor SO on the knife cylinder 8, then the set point $Y_{16w}^{o*}$ is tracked in accordance with the set point $Y_{18w}^{o}$.

As compared with System 5, the register error arising between the turner superstructure and knife cylinder 8 is additionally corrected. As compared with System 6, all the errors arising within the turner superstructure are substantially controlled out by the subordinated loops (controllers 6*a*.2 and 6*b*.2). The superimposed controller 6*b*.1 is relieved of load as a result. This system has advantages in the case of particularly long paths between turner superstructure (first clamping point 3 ($K_3$) of the turner device 4 as far as the former roll 6*c* and knife cylinder 8.

For the decoupled predefinition of the tensions ($F_{34,a}$) and/or ($F_{34,b}$) in the lower web (BU) and/or upper web (BO) in the web sections 3-4*a* and/or 3-4*b*—but not in the sections 4*a*-6*a* and 4*b*-6*b* because of the self-compensation property—the controlled clamping points 4*a* ($K_{4a}$) and 4*b* ($K_{4b}$) are provided. Tension control loops are superimposed on the rotational speed control loops (controllers 4*a*.3 and/or 4*b*.3). They process the difference between the actual tension value (sensor SFU and/or SFO) and the tension set point ($F_{34a,w}$ and/or $F_{34,b,w}$).

The clamping points 4*a* ($K_{4a}$) and 4*b* ($K_{4b}$) and 6*a* ($K_{6a}$) and 6*b* ($K_{6b}$) are designed either with full-width pressing rolls or with trolleys and additional wrap, which means that these become complete and almost slip-free clamping points.

This method is combined with the slow readjustment of the angular position of the printing units, described in Patent Application Publication No. US 2005/0034578, in order to avoid excessively large leads, or with the combined tension-register control in accordance with Patent Application Publication Nos. US 2005/0061189 or US 2005/0039622, which relates to the web sections located before the clamping point 3 ($K_3$).

3. Systems With a Plurality of Folding Formers

Figure 9:
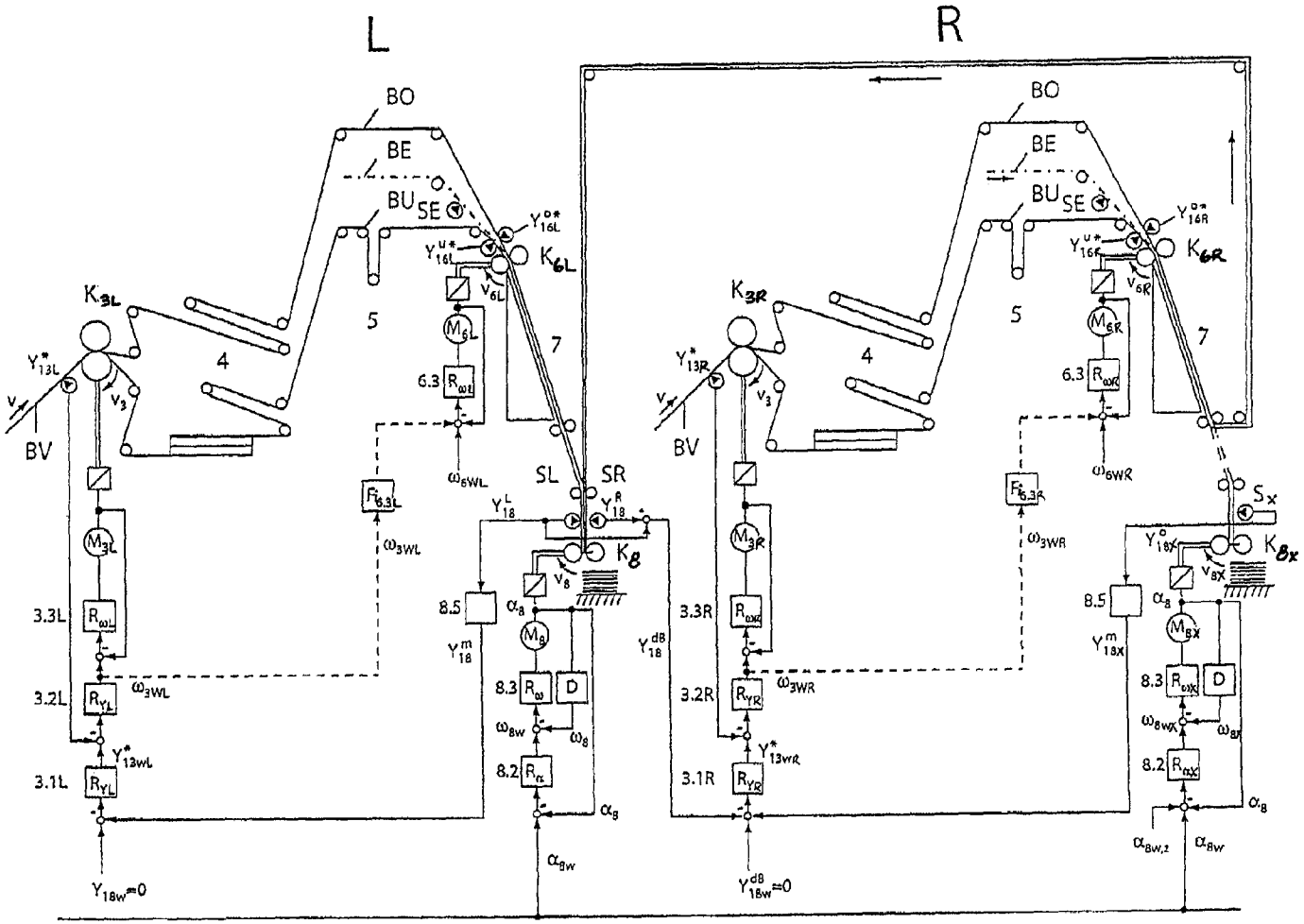
FIG. 9 shows an arrangement for controlling the cut register and a web tension in multi-web operation, in particular having a plurality of web bundles, system 8.

It will now be assumed that a plurality of web bundles from different folding folders are supplied to the common knife cylinder clamping point 8 ($K_8$), as FIG. 9 shows by using the example of two presses L and R. If the bundle from each system on its own maintains register in relation to the clamping points 1L ($K_{1L}$) and 1R ($K_{1R}$), respectively, then in general it is generally true of the differential cut register error ($Y_{18}^{db}=Y_{18}^{L}-Y_{18}^{R}$) of the two bundles that this is not zero. The object is then to control this difference to the set point $Y_{18}^{db}=0$. For this purpose, at least two manipulated variables are needed, with which the web bundles can be influenced separately. In addition, only manipulated variables which are able to influence the entire bundle from the respective machine are suitable. After the common clamping point 8 ($K_8$), acts on the two bundles, control by means of an angular adjustment of the knife cylinder analogous to FIG. 2 (System 1) fails. Therefore, the clamping points 3L ($K_{3L}$) and 3R ($K_3$R) are recommended, which can correct the relevant part cut register of the full-width web, or else the former rolls 6L and 6R, in which case, however, it is necessary to take account of the fact that, in the control case, they are afflicted by sliding slippage. The first variant will be described in the following text as System 8.

System 8: Register measurement on the knife cylinder with subordination of the part register error at the turner units (analogous to FIG. 3)

As in the method according to System 2, leads are advantageously to be used as manipulated variables. Since the range of manipulation of the lead changes is limited because of the associated force changes, an initial state must first be produced, so that $Y_{18}^{dB}\approx Y_{18w}^{dB}=0$. For this purpose, the clamping points 1L ($K_{1L}$) and 1R ($K_{1R}$), that is to say the printing units of the machine L and of the machine R, have to be synchronized appropriately in terms of their angular position by the two electronic shafts being coupled to each other. For instance, the shaft L can be the guide shaft for shaft R. Additional angle set points (e.g. $\alpha_{8w,z}$ in FIG. 9) permit the adaptation of the clamping point 1R ($K_{1R}$) to the clamping point 1L ($K_{1L}$) in accordance with the initial condition $Y_{18}^{dB}\approx 0$. In addition, it is assumed that each web bundle is intrinsically controlled to a minimum achievable cut register error of the strands in accordance with one of the methods from System 2.

The cut register errors of the web bundles are registered directly before the knife cylinder 8 by the sensors SL and SR, which supply the actual values $Y_{18}^{L}$ and $Y_{18}^{R}$. From these, the difference $Y_{18}^{dB}=Y_{18}^{L}-Y_{18}^{R}$ is also formed and supplied to the controller 3.1R, which controls this difference to the set point $Y_{18w}^{dB}=0$.

If a disturbance then occurs in one of the systems, for example a reel change, then an error $Y_{18}^{dB}\neq Y_{18w}^{dB}$ is caused, which is to be controlled out.

If this disturbance occurs in the machine L, then the subordinate register control loop for $Y_{13L}^{*}$ (controller 3.2L) performs a rapid pre-correction and the controller 3.1L controls the disturbance to $Y_{18w}$=const, in particular to the value $Y_{18w}=0$. The difference $y_{18}^{db}$ arising during this compensating procedure is simultaneously led back to to the value $Y_{18w}^{db}=0$ by the controller 3.1R, that is to say the cut register of the machine R is tracked to the machine L.

In the event of an incoming disturbance in the machine R, the subordinate register control loop for $Y_{13L}^{*}$ (controller 3.2R) performs a rapid pre-correction, while the register controller 3.1R leads the difference $Y_{18}^{db}$ produced back to the value $Y_{18w}^{db}=0$. In theory, the cut register error $Y_{18}^{L}$ is not affected as a result. Should this nevertheless be the case because of a certain mechanical coupling of the two bundles, then the cut register error $Y_{18}^{L}$ is simultaneously controlled out by the controller 3.1L.

The clamping points 6L ($K_{6L}$) and 6R ($K_{6R}$)or other clamping points which, as a result of their leads, act on the full-width web or on the entire bundle, can also occur instead of the clamping points 3L ($K_{3L}$) and 3R ($K_{3R}$).

LITERATURE

[Föl 88] Föllinger, O.: Regelungstechnik [Control engineering], Heidelberg: Hüthig-Verlag 1988

[Bra 96] Brandenburg, G., Papiernik, W.: Feedforward and feedback strategies applying the principle of input balancing for minimal errors in CNC machine tools. Proc. 4th Workshop on Advanced Motion Control, AMC '96-MIE, Vol. 2, pp. 612-618

What is claimed is:

1. A method for controlling the cut register in a web fed press through which a plurality of webs are fed, the press having a printing unit, a common knife cylinder which cuts the webs, and a plurality of clamping points between the printing unit and the knife cylinder, wherein said printing unit prints each web with a printed image and one of image information and measuring marks suitable for the deviation of the position of the printed image with respect to its intended position based on the time and position of cutting at the knife cylinder, said deviation constituting the cut register error, the method comprising:

measuring said one of image information and measuring marks from at least one said web at least one of before and on the knife cylinder by at least one sensor;

forming an actual value for controlling the cut register error of the at least one said web by at least one of evaluating and transforming said one of image information and measuring marks measured by the at least one sensor; and correcting the cut register error of the at least one web to a predefined set point by changing at least one of a speed of at least one clamping point and the position of the knife cylinder in accordance with the actual value, said step of correcting comprising:

correcting a part cut register error by changing at least one of an angular velocity of one of said clamping points, and an angular velocity of the knife cylinder, and wherein a speed of a former roll not being affected, the former roll located between the printing unit and the knife cylinder;

correcting the cut register error of a lower web by changing an angular velocity of a further clamping point; and correcting the cut register control of an upper web by changing an angular velocity of the former roll, wherein a rotational speed or angle control loop of the drive motor coupled to the former roll and the further clamping point is subordinated to a register controller for the former roll and the further clamping point, the actual values used being part cut register errors measured before the knife cylinder or a differential cut register error between the upper web and the lower web and the part cut register error, pre-control of the control loops taking place via filters.

2. The method of claim 1 comprising:

measuring a web tension of at least one web at or before one of said clamping points; and setting and controlling said web tension and the part cut register error in a manner decoupled from each other and simultaneously in accordance with appropriate set points by means of manipulated variables, so that the web tension assumes its set point, which lies in a prescribed range, and the cut register error is corrected to its predefined set point.

3. The method of claim 2 wherein said manipulated variables comprise at least one of circumferential speeds of the clamping points, angular positions of the printing unit, and mass flow supplied to the system, said mass flow being set by circumferential speeds of winding devices with the aid of one of a dancer adapted to tension the web, self-aligning rolls adapted to tension the web, and tension control loops adapted to tension the web.

4. The method of claim 1 wherein said actual value is determined from at least one of the plurality of webs comprising at least one of a full width web, at least one individual web, an upper web, a lower web, and all the webs.

5. The method of claim 1 wherein the actual value for controlling a total cut register error of at least one web is formed using at least one of a mathematical model and data which is measured and stored.

6. The method of claim 1 wherein said plurality of webs comprise at least one of full width webs and part width webs, the method comprising setting part cut register errors and web tensions separately from one another by means of control loops using appropriate set points.

7. The method of claim 6 wherein the webs are from different folding formers arranged before the common knife cylinder in a direction of the web and are folded by the common knife cylinder.

8. The method of claim 1 wherein control loops are provided in a cascade structure for changing speeds and angular positions of the clamping points in order to influence part cut register errors and a total cut register error.

9. The method of claim 1 comprising:

providing a register controller for one of said clamping points, an angular velocity control loop and an angle control loop being subordinated to said register controller for said clamping point;

correcting a part cut register error in at least one of the webs at said one of said clamping points by said register controller for said clamping point;

providing a register controller for said knife cylinder, a rotational speed control loop and a current control loop being subordinated to said register controller for the knife cylinder; and correcting a total cut register error of all the webs by changing the position of the knife cylinder by means of the register controller for the knife cylinder.

10. The method of claim 1 comprising:

measuring the cut register error on the knife cylinder;

providing a cut register controller for one of said clamping points, an angular velocity control loop being subordinated to said cut register controller for said clamping point;

superimposing an error register controller on a cut register controller adapted to receive precut register error, the error register controller tracking a set point in accordance with the cut register error measured at the knife cylinder; and correcting a total cut register error of all the webs by changing the angular velocity of said one of said clamping points, the angular velocity of the knife cylinder not being affected.

11. A method for controlling the cut register in a web fed press through which a plurality of webs are fed, the press having a printing unit, a common knife cylinder which cuts the webs, and a plurality of clamping points between the printing unit and the knife cylinder, wherein said printing unit prints each web with a printed image and one of image information and measuring marks suitable for the deviation of the position of the printed image with respect to its intended position based on the time and position of cutting at the knife cylinder, said deviation constituting the cut register error, the method comprising:

measuring said one of image information and measuring marks from at least one said web at least one of before and on the knife cylinder by at least one sensor;

forming an actual value for controlling the cut register error of the at least one said web by at least one of evaluating and transforming said one of image information and measuring marks measured by the at least one sensor;

correcting a part cut register error by changing an angular velocity of one of said clamping points, the angular velocity of the knife cylinder not being affected;

correcting the cut register error of a lower web by changing the angular velocity of a former roll using an actual value which is the register error measured on or before the knife cylinder, the former roll located between the printing unit and the knife cylinder;

correcting the cut register error of an upper web by changing the angular velocity of a further clamping point using an actual value which is the difference between the register error of the lower web and the register error of the upper web; and interchanging the assignment of the set points to the former roll and the further clamping point, a rotational speed and angle control loops of the drive motors coupled to the former roll and the further clamping point being subordinated to register controllers for the former roll and the further clamping point, pre-control of the control loops taking place via filters.

12. A method for controlling the cut register in a web fed press through which a plurality of webs are fed, the press having a printing unit, a common knife cylinder which cuts the webs, and a plurality of clamping points between the printing unit and the knife cylinder, wherein said printing unit prints each web with a printed image and one of image information and measuring marks suitable for the deviation of the position of the printed image with respect to its intended position based on the time and position of cutting at the knife cylinder, said deviation constituting the cut register error, the method comprising:

measuring said one of image information and measuring marks from at least one said web at least one of before and on the knife cylinder by at least one sensor;

forming an actual value for controlling the cut register error of the at least one said web by at least one of evaluating and transforming said one of image information and measuring marks measured by the at least one sensor;

correcting a part cut register error of a full width web by changing at least one of an angular velocity of one of said clamping points, and an angular velocity of the knife cylinders, and wherein a speed of a former roll not being affected, the former roll located between the printing unit and the knife cylinder;

correcting the cut register error of an upper web by changing an angular velocity of said one of said clamping points using an actual value which is the register error measured on or before the knife cylinder; and correcting the cut register error of a lower web by changing the angular velocity of a further clamping point using an actual value which is the difference between the register error of the lower web and one of the register errors of the upper web;

wherein a rotational speed and angle control loops of the drive motor of the further clamping point are subordinated to register controllers for the further clamping point, pre-control of the control loop taking place via a filter.

13. The method of claim 12 wherein the actual value used at the register controllers for the further clamping point is the total cut register error on the knife cylinder.

14. The method of claim 13 wherein the register controller, which predefines the set point for the register controller for the further clamping point, is superimposed on the register control loop for the upper web, the actual value used being the register error measured on the knife cylinder.

15. The method of claim 1 for controlling two said web fed presses including a master press and a slave press, the method comprising:

feeding the webs from both of said machines to a common knife cylinder associated with the master press;

synchronizing the printing units of the machines via the common set point by using at least one additional angle set point at the slave press;

correcting the total cut register error of the master press being controlled by a cut register controller of the master machine; and correcting the differential cut register error of the slave press being controlled by a cut register controller of the slave press.

16. Apparatus for controlling the cut register in a web fed press through which a plurality of webs are fed, the press having a printing unit, a common knife cylinder which cuts the webs, and a plurality of clamping points between the printing unit and the knife cylinder, wherein said printing unit prints each web with a printed image and one of image information and measuring marks suitable for the deviation of the position of the printed image with respect to its intended position based on the time and position of cutting at the knife cylinder, said deviation constituting the cut register error, the apparatus comprising:

drive motors with associated current control, rotational speed control, and angle control for controlling the clamping points independently;

at least one sensor for registering at least one cut register error by measuring said one of image information and measuring marks from at least one said web at least one of before and on the knife cylinder;

at least one further sensor for measuring at least one web tension;

control devices which change one of a circumferential speeds and angular positions of respective said clamping points by at least one of open-loop and closed loop control of the drive motors; and a man-machine interface for setting the web tension in a section of the web and the register error in another or the same web section in a manner decoupled from one another by means of set points, wherein the control devices are configured to:

correct a part cut register error by changing an angular velocity of one of said clamping points, and an angular velocity of the knife cylinder, and wherein a speed of a former roll not being affected, the former roll located between the printing unit and the knife cylinder;

correct the cut register error of a lower web by changing an angular velocity of a further clamping point; and correct the cut register control of an upper web by changing an anangular velocity of the former roll, wherein an rotational speed or angle control loop of the drive motor of the former roll and the further clamping point is subordinated to a register controller for the former roll and the further clamping point, the actual values used being part cut register errors measured before the knife cylinder or a differential cut register error between the upper web and the lower web and the part cut register error, pre-control of the control loops taking place via filters.

17. The apparatus of claim 16 further comprising:

unwinds which introduce mass flow measured in kg/sec into the press, the unwinds having circumferential speeds; and dancer rolls or web tension control loops which, with the aid of the circumferential speeds, are configured to change the mass flow.

18. The apparatus of claim 16 wherein the sensors comprise interfaces which transmit the cut register error and web tension via one of field buses, Ethernet, communication buses, and communication interfaces.

19. The apparatus of claim 16 wherein the control devices are implemented as one of a central computer and an embedded computer, or in a functionally decentralized form in respective converter devices, and wherein the control devices are configured to process all the information including actual values, set points, and algorithms in real time.

20. Apparatus for controlling the cut register in a web fed press through which a plurality of webs are fed, the press having a printing unit, a common knife cylinder which cuts the webs, and a plurality of clamping points between the printing unit and the knife cylinder, wherein said printing unit prints each web with a printed image and one of image information and measuring marks suitable for the deviation of the position of the printed image with respect to its intended position based on the time and position of cutting at the knife cylinder, said deviation constituting the cut register error, the apparatus comprising:

drive motors with associated current control, rotational speed control, and angle control for controlling the clamping points independently;

at least one sensor for registering at least one cut register error by measuring said one of image information and measuring marks from at least one said web at least one of before and on the knife cylinder;

at least one further sensor for measuring at least one web tension;

control devices which change one of circumferential speeds and angular positions of respective said clamping points by at least one of open-loop and closed loop control of the drive motors; and a man-machine interface for setting the web tension in a section of the web and the register error in another or the same web section in a manner decoupled from one another by means of set points, wherein the control devices are configured to:

correct a part cut register error by changing at least one of an angular velocity of one of said clamping points, wherein an angular velocity of the knife cylinder not being affected;

correct the cut register error of a lower web by changing an angular velocity of a former roll using an actual value which is the register error measured on or before the knife cylinder, the former roll located between the printing unit and the knife cylinder;

correct the cut register error of an upper web by changing an angular velocity of a further clamping point using an actual value which is the difference between the register error of the lower web and the register error of the upper web; and interchange the assignment of the set points to the former roll and the further clamping point, a rotational speed and angle control loops of the drive motors coupled to the former roll and the further clamping point being subordinated to register controllers for the former roll and the further clamping point, pre-control of the control loops taking place via filters.

21. Apparatus for controlling the cut register in a web fed press through which a plurality of webs are fed, the press having a printing unit, a common knife cylinder which cuts the webs, and a plurality of clamping points between the printing unit and the knife cylinder, wherein said printing unit prints each web with a printed image and one of image information and measuring marks suitable for the deviation of the position of the printed image with respect to its intended position based on the time and position of cutting at the knife cylinder, said deviation constituting the cut register error, the apparatus comprising:

drive motors with associated current control, rotational speed control, and angle control for controlling the clamping points independently;

at least one sensor for registering at least one cut register error by measuring said one of image information and measuring marks from at least one said web at least one of before and on the knife cylinder;

at least one further sensor for measuring at least one web tension;

control devices which change one of circumferential speeds and angular positions of respective said clamping points by at least one of open-loop and closed loop control of the drive motors; and a man-machine interface for setting the web tension in a web section of the plural webs and the register error in another or the same web section in a manner decoupled from one another by means of set points, wherein the control devices are configured to:

correct a part cut register error of a full width web by changing the angular velocity of one of said clamping points, and an angular velocity of the knife cylinder, and wherein a speed of a former roll not being affected, the former roll located between the printing unit and the knife cylinder;

correct the cut register error of an upper web by changing the by changing the angular velocity of said one of said clamping points using an actual value which is the register error measured on or before the knife cylinder; and correct the cut register error of a lower web by changing an angular velocity of a further clamping point using an actual value which is the difference between the register error of the lower web and one of the register errors of the upper web;

wherein a rotational speed and angle control loops of the drive motor coupled to the further clamping point are subordinated to register controllers for the further clamping point, pre-control of the control loop taking place via a filter.

* * * * *